US010663119B2

(12) United States Patent
Lin et al.

(10) Patent No.: US 10,663,119 B2
(45) Date of Patent: May 26, 2020

(54) LED FILAMENT FOR OMNIDIRECTIONAL LAMP

(71) Applicant: LEDVANCE GmbH, Garching bei München (DE)

(72) Inventors: Jing Lin, Guangdong (CN); Shijun Nie, Guangdong (CN); Shaozhu Yang, Guangdong (CN)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 15/805,573

(22) Filed: Nov. 7, 2017

(65) Prior Publication Data

US 2018/0135810 A1 May 17, 2018

(30) Foreign Application Priority Data

Nov. 16, 2016 (CN) ..... 2016 2 1473941 U

(51) Int. Cl.

| | |
|---|---|
| ***F21K 9/232*** | (2016.01) |
| ***F21K 9/237*** | (2016.01) |
| ***F21S 4/22*** | (2016.01) |
| ***F21K 9/235*** | (2016.01) |
| ***F21V 3/02*** | (2006.01) |
| *F21Y 107/10* | (2016.01) |
| *F21Y 115/10* | (2016.01) |

(52) U.S. Cl.

CPC ..... *F21K 9/237* (2016.08); *F21K 9/232* (2016.08); *F21K 9/235* (2016.08); *F21S 4/22* (2016.01); *F21V 3/02* (2013.01); *F21Y 2107/10* (2016.08); *F21Y 2115/10* (2016.08)

(58) Field of Classification Search

CPC ..... F21K 9/23–278; F21S 4/22; F21S 4/24; F21S 4/26; F21Y 2107/70

See application file for complete search history.

(56) References Cited

U.S. PATENT DOCUMENTS

| | | | | |
|---|---|---|---|---|
| 2004/0008525 | A1* | 1/2004 | Shibata | F21K 9/232 313/271 |
| 2013/0235592 | A1* | 9/2013 | Takeuchi | F21V 23/001 362/363 |
| 2014/0247595 | A1* | 9/2014 | Lind | G09F 13/0404 362/249.04 |
| 2014/0268779 | A1* | 9/2014 | Sorensen | F21K 9/232 362/249.06 |

* cited by examiner

*Primary Examiner* — Sean P Gramling
(74) *Attorney, Agent, or Firm* — Hayes Soloway PC

(57) ABSTRACT

A LED filament for an omnidirectional lamp comprises two longitudinal filament sections, and each filament section includes a plurality of LEDs. The two filament sections are electrically conductively connected by a flexible connecting section. A lamp using such LED filaments provides a light distribution having an increased homogeneity.

26 Claims, 2 Drawing Sheets

LED FILAMENT FOR OMNIDIRECTIONAL LAMP

CROSS-REFERENCE TO RELATED APPLICATION AND PRIORITY

This patent application claims priority from Chinese Patent Application No. 201621473941.8, filed on Nov. 16, 2016, which is herein incorporated by reference in its entirety.

TECHNICAL FIELD

The present invention relates to LED filaments which simplify the design of omnidirectional lamps.

BACKGROUND

A specific type of LED lamps uses LED filaments, i.e. strip-like LED elements which typically comprise a plurality of LEDs arranged in a row on a strip-like carrier (e.g. metal, glass, or sapphire materials). The LEDs may be coated by a coating for converting the light generated by the LEDs into a desired wavelength range. Multiple LED filaments are usually arranged inside a bulb of a lamp (e.g. a LED retrofit lamp having an Edison type lamp base, such as E27 or E14). LED filaments usually are arranged essentially parallel to the longitudinal axis of the lamp. In order to minimize the generation of shadows, the LED filaments in a lamp can be arranged with a slight deviation from said longitudinal direction, such that not all LED filaments are positioned parallel to each other.

LEDs usually show a Lambertian light distribution, i.e. the highest intensity is emitted towards a main direction (usually perpendicular to the surface of the LED) and intensity decreases in other directions with the cosine of the angle between the other direction and the main direction. Light emission in the longitudinal direction of the LED filament therefore is very limited. Accordingly, light distribution of such lamps is inhomogeneous. In particular, much less light is emitted in the longitudinal direction of the lamp than in the lateral direction. If, for example, a lamp using LED filaments is hanging from the ceiling (e.g. over a table), the area directly under the lamp receives much less light than the areas to the side of the lamp.

Such inhomogeneous light distribution often is unwanted and is for example an obstacle for obtaining Energy Star certification which requires that 90% of the measured intensity values in a vertical plane vary by no more than 25% from the average of all measured values in all planes.

SUMMARY OF THE INVENTION

In view of the known prior art, it is an object of the present invention to provide an LED filament which allows the design of LED lamps having improved homogeneity of the light distribution, such as omnidirectional LED lamps, in particular retrofit LED lamps.

This object is solved by an LED filament according to the independent claim. Preferred embodiments are given by the dependent claims.

A LED filament accordingly to the present invention comprises a first longitudinal filament section and a second longitudinal filament section, each filament section being provided with a plurality of LEDs. Longitudinal is understood to mean that the extension of the filament section in one direction is larger than the extension in the perpendicular direction. Usually, in known LED filaments, LEDs are positioned in a row, and neighboring LEDs are electrically connected to each other. The same design may be used for positioning the LEDs on each of the two filament section. Essentially, each filament section corresponds to the filament section of a known LED filament, although it will usually be shorter.

A flexible connecting section electrically conductively connects the first filament section and the second filament section. Accordingly, both filament sections are attached to each other via the connecting section. Since the connecting section is flexible, i.e. it may be bent into a different shape either by hand or by a machine producing the inventive LED filament, the relative positioning (and in particular the angle) between the two filament sections may be adjusted. Preferably, the connecting section will keep its shape after it has been deformed into the desired shape.

The flexible connecting section can be located at least partially between the first filament section and the second filament section, so that both filament sections are separated from each other by a distance that is equal to or smaller than the length of the connecting section. Alternatively, the connecting section can be attached to the filament section such that in an unbent state of the connecting section one end of the first filament section and one end of the second filament section are positioned next to each other, thus giving the appearance of a conventional LED filament having just a single filament section.

Preferably, each filament section comprises a substrate, wherein the LEDs of each filament section are mounted on the respective substrate. The substrate may be made from glass, sapphire, a PCB material, plastics, metal, or any other material suitable for being used as a LED substrate.

At least one of the first filament section and the section filament section may comprise a conversion layer applied over the plurality of LEDs for converting the color of the light emitted by the LEDs during operation. This allows the color of the light emitted by the LED filament to be chosen according to the desired parameters. Such a conversion layer may comprise for example phosphor. In particular the LED filament may emit white light. This can for example be achieved by LEDs emitting blue light and a phosphor layer converting a portion of the emitted blue light into yellow light. The mixture of the directly emitted blue light and the converted yellow light then appears white.

Each filament section may comprise an electrical connector at its end (outer end) opposite the end with the flexible connecting section (inner end). Thus, the inventive LED filament may be used in the same way and for the same applications as known LED filaments, in particular is the total length of the inventive LED filament essentially equal to the length of a known LED filament.

LED filaments according to the present invention may be applied in known applications as well as in applications not possible or at least difficult to realize with known LED filaments. Since the connecting section may be bent into different shapes, various configurations of the LED filament are possible, allowing various lamp design, even without the need of additional optical elements such as lenses or reflectors.

In a preferred embodiment the connecting section is made from the same material as the electrical connectors. This allows the methods for attaching the electrical connectors to the filament sections to be used also for attaching the connecting section to the filament sections. This simplifies manufacturing of the inventive LED filament.

The flexible connecting section may comprise or even solely consist of a metal wire or a piece of sheet metal. This further simplifies manufacturing of the inventive LED filament.

The present invention further relates to a lamp comprising a translucent (preferably transparent) bulb, a lamp base, and one or more LED filaments according to the present invention as explained above. Preferably, the LED filaments are attached to a holder which holds the LED filaments in a desired relative orientation to each other. The LED filaments may be used in a straight configuration, a bent configuration, or a combination of the two. The holder can also comprise electrical conductors which can be used for supplying the LED filaments with electrical power. The lamp base may be any known lamp base, such as a threaded Edison type lamp base (e.g. E14, E27), a bayonet type lamp base, a dual pin type lamp base, etc. The bulb may be manufactured from plastics or glass or any other suitable translucent (preferably transparent) material.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1A:
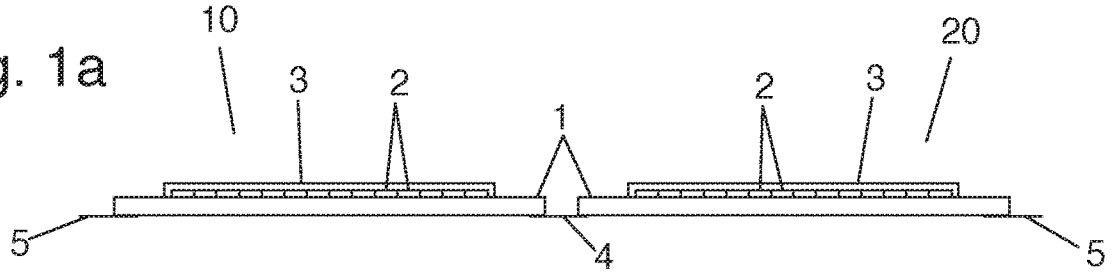
FIG. 1*a/b* schematic drawings of a first embodiment of a LED filament according to the present invention in two configurations.

In FIG. 1*a* a schematic drawing of a first embodiment of a LED filament according to the present invention is shown. The LED filament comprises two filament sections 10,20, each filament section comprising a substrate 1 on which a plurality of LEDs 2 is provided. The LEDs 2 are mounted on the substrate 1 and are provided with electrical connections in the same manner as used for known LED filaments. A phosphor conversion layer 3 is applied over the LEDs 2 and converts light emitted by the LEDs 2 into a desired wavelength.

The filament sections 10,20 are mechanically and electrically connected to each other by a connecting section 4 which comprises a metal wire. On the end opposite the end connected to the connecting section, each filament section 10,20 is provided with an electrical connector 5 which comprises a metal wire.

Figure 1B:
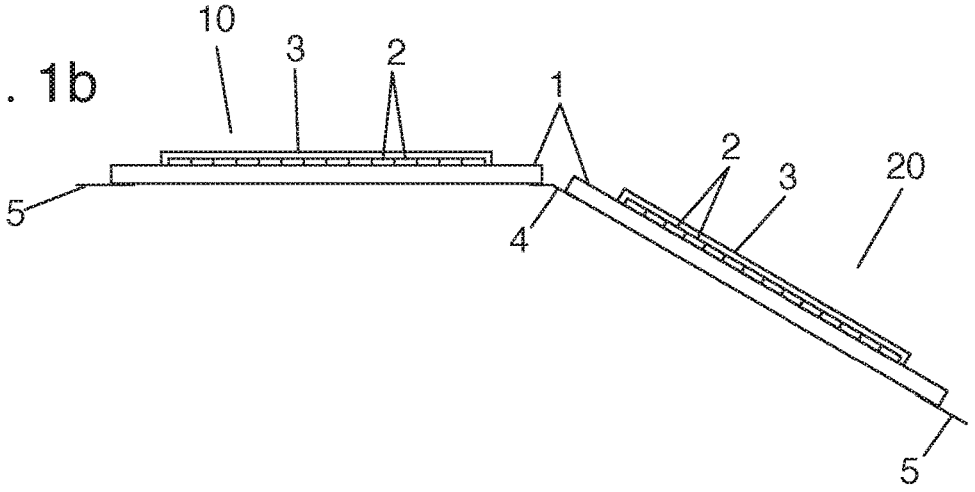

FIG. 1*a* shows the LED filament in a straight configuration where both filament sections 10,20 essentially extend in the same direction. In FIG. 1*b* the same embodiment of a LED filament is shown in an angled configuration where the connecting section 4 has been bent such that the filament sections 10,20 extend in different directions which form an angle therebetween.

Figure 2A:
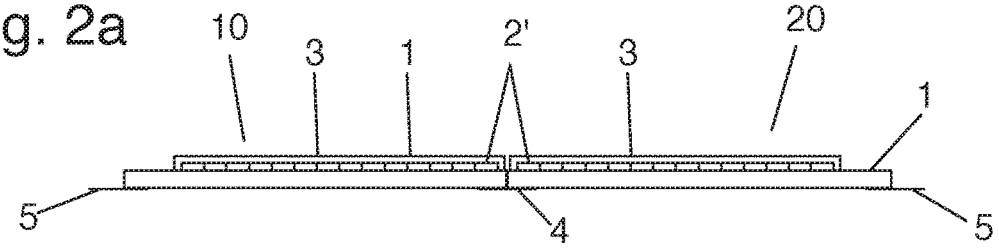
FIG. 2*a/b* schematic drawings of a second embodiment of a LED filament according to the present invention in two configurations.
Figure 2B:
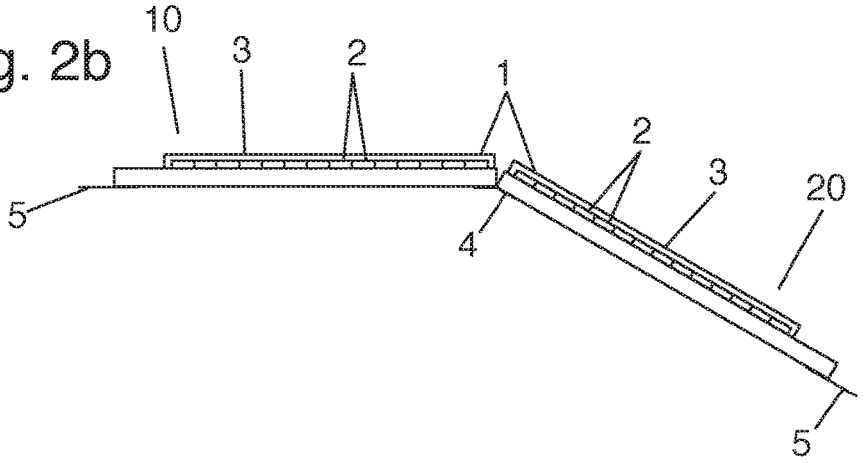

In FIG. 2*a* a schematic drawing of a second embodiment of a LED filament according to the present invention is shown. The LED filament comprises two filament sections 10,20, each filament section 10,20 being configured similarly to the filament sections 10,20 of the first embodiment. As a difference between the first and the second embodiment, the LEDs 2 are positioned on the substrate 1 up to close to the end of the substrate 1 being provided with the connecting section 4. Thus, in the straight configuration shown in FIG. 2*a*, the gap between the innermost LEDs 2' on each filament section 10,20 is much smaller than the corresponding gap in the first embodiment. The light distribution of the LED filament according to the second embodiment, therefore, resembles the light distribution of a known, "one-piece" LED filament. Even in the bent configuration shown in FIG. 2*b*, the distance between the innermost LEDs 2' is very small, ensuring a more homogeneous light distribution.

Figure 3:
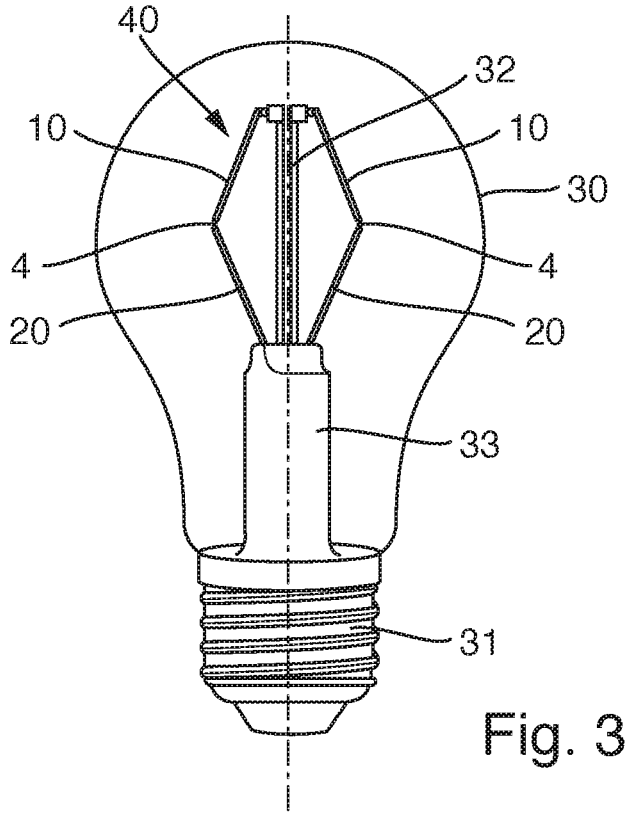
FIG. 3 a schematic drawing of an embodiment of a lamp according to the present invention.

FIG. 3 shows an embodiment of a lamp according to the present invention. The lamp comprises a transparent glass bulb 30 fixed to an Edison type lamp base 31. Inside the bulb 31, several LED filaments 40 according to the present invention are fixed to a holding structure 32. The lamp may comprise 2, 3, 4, 5, 6, 7, 8 or any other number of LED filaments 40. In order to allow better understanding of the drawing, only two LED filaments 40 are shown in FIG. 3. Each LED filament 40 comprises two filament sections 10,20 which are electrically connected by a connecting section 4. The connecting section 4 is bent such that the two filament sections 10,20 are arranged under an angle of about 45°. Accordingly, the LED filaments 40 emit light not only towards the side of the lamp but also in the longitudinal direction (indicated by the longitudinal axis A), creating a light distribution that is more homogenous than the light distribution of lamps using known LED filaments.

The holding structure 32 is mounted to a socket 33 which in turn is mounted to the lamp base 31. A driver for the LED filaments 40 may be arranged inside the lamp base 31 and is not visible in FIG. 3. Depending on the number and operating parameters of the LED filaments 40, a driver might not necessarily be required. Socket 33 and holder 32 also comprise electrical connections for supplying electrical power to the LED filaments 40.

Figure 4:
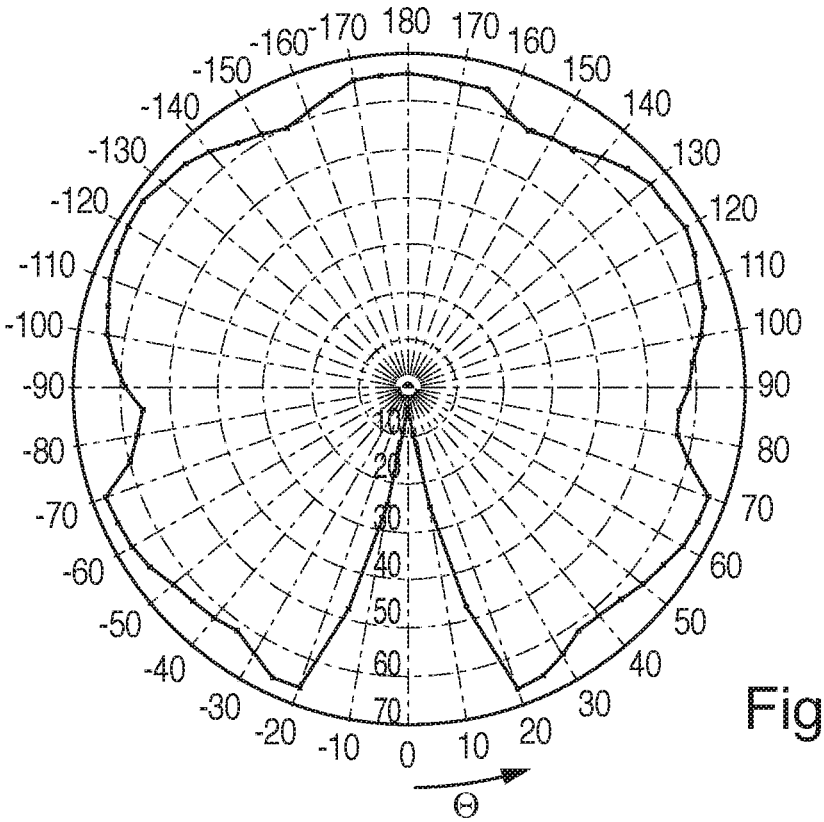
FIG. 4 a diagram of the simulated light distribution of a lamp according to the present invention.

FIG. 4 shows a diagram of the simulated light distribution of a lamp as shown in FIG. 3 using four LED filaments according to the present invention. The diagram shows in polar coordinates the relative intensities of the emitted light in different directions. The simulated intensity values are shown in FIG. 4 for a single plane including the longitudinal axis of the lamp. For $\Theta<20°$ the intensity is very small, since the light emitted by the LED filaments is blocked by the lamp base. Starting from $\Theta=20°$ up to $\Theta=180°$ the intensity is high and varies only slightly and thus fulfills the Energy Star requirement that 90% of the measured intensity values in a vertical plane vary by no more than 25% from the average of all measured values.

Although the invention has been illustrated and described in detail by the embodiments explained above, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical values may include the exact value as well as a usual tolerance interval, unless this is explicitly excluded.

Features shown in the embodiments, in particular in different embodiments, may be combined or substituted without leaving the scope of the invention.

LIST OF REFERENCE NUMBERS

1 substrate
2, 2' LED
3 conversion layer
4 connecting section
5 electrical connector
10 first filament section
20 second filament section
30 bulb
31 lamp base
32 holder
33 socket
40 LED filament

The invention claimed is:

1. A lamp comprising:
a bulb;
a lamp base;
a holding structure disposed within the bulb and extending from the lamp base along a longitudinal axis of the lamp; and
one or more light-emitting diode (LED) filaments disposed within the bulb, fixed to the holding structure such that the one or more LED filaments angle away from the longitudinal axis of the lamp, and electrically coupled with the lamp base via the holding structure, wherein the one or more LED filaments comprise:
a first longitudinal filament section comprising a first plurality of LEDs mounted on a first side of a first substrate;
a second longitudinal filament section comprising a second plurality of LEDs mounted on a first side of a second substrate; and
a flexible connecting section electrically conductively connecting the first longitudinal filament section and the second longitudinal filament section on an opposing second side of the respective first and second substrates and bent at an angle such that the first and second longitudinal filament sections angle away from one another in different directions, wherein the flexible connecting section is not extensible;
wherein the first longitudinal filament section and the second longitudinal filament section each comprise an electrical connector at its end opposite an end with the flexible connecting section.

2. The lamp according to claim 1, wherein at least one of the first filament section and the second filament section comprises a conversion layer applied over the plurality of LEDs for converting a color of light emitted by the LEDs during operation.

3. The lamp according to claim 1, wherein the flexible connecting section is made from the same material as the electrical connectors.

4. The lamp according to claim 1, wherein the flexible connecting section comprises a metal wire.

5. The lamp according to claim 1, wherein the flexible connecting section comprises a piece of sheet metal.

6. The lamp according to claim 1, wherein the flexible connecting section is bent through an angle of about 45° or less.

7. The lamp according to claim 1, wherein the first and second filament sections are not co-planar.

8. The lamp according to claim 1, wherein the first and second filament sections are physically connected to one another only by the flexible connecting section.

9. The lamp according to claim 1, wherein the respective substrates are made from at least one of a glass, a sapphire, a printed circuit board (PCB) material, a plastic, and a metal.

10. The lamp according to claim 1, wherein at least one of:
the first side on which the first plurality of LEDs is mounted is a surface of the first substrate; and
the second side on which the second plurality of LEDs is mounted is a surface of the second substrate.

11. The lamp according to claim 1, wherein the first longitudinal filament section and the second longitudinal filament section are situated immediately adjacent one another such that, in an unbent state of the flexible connecting section, there is no appreciable gap between the first substrate and the second substrate.

12. The lamp according to claim 1, wherein the first substrate and the second substrate physically contact one another at the ends where the flexible connecting section is disposed.

13. The lamp according to claim 1, wherein the lamp further comprises a socket mounted to the lamp base, wherein the holding structure is mounted to the socket.

14. A lamp comprising:
a bulb;
a lamp base;
a holding structure extending from the lamp base along a longitudinal axis of the lamp; and
one or more light-emitting diode (LED) filaments disposed within the bulb, fixed to the holding structure such that the one or more LED filaments angle away from the longitudinal axis of the lamp, and electrically coupled with the lamp base via the holding structure, wherein the one or more LED filaments comprise:
a first longitudinal filament section comprising a first plurality of LEDs mounted on a first side of a first substrate;
a second longitudinal filament section comprising a second plurality of LEDs mounted on a first side of a second substrate; and
a flexible connecting section electrically conductively connecting the first longitudinal filament section and the second longitudinal filament section on an opposing second side of the respective first and second substrates and bent at an angle such that the first and second longitudinal filament sections angle away from one another in different directions, wherein the flexible connecting section is not extensible;
wherein:
each of the first and second longitudinal filament sections has opposing first and second ends;
the second end of the first longitudinal filament section and the first end of the second longitudinal filament section are disposed proximal one another; and
the first end of the first longitudinal filament section and the second end of the second longitudinal filament section are disposed distal one another and fixed to the holding structure via respective electrical connectors such that a longitudinal length of the one or more LED filaments is generally parallel to the longitudinal axis of the lamp.

15. The lamp according to claim 14, wherein the first and second substrates are made from at least one of a glass, a sapphire, a printed circuit board (PCB) material, a plastic, and a metal.

16. The lamp according to claim 14, wherein at least one of the first filament section and the second filament section comprises a conversion layer applied over the plurality of LEDs for converting a color of light emitted by the LEDs during operation.

17. The lamp according to claim 14, wherein the flexible connecting section is made from the same material as the electrical connectors.

18. The lamp according to claim 14, wherein the flexible connecting section comprises a metal wire.

19. The lamp according to claim 14, wherein the flexible connecting section comprises a piece of sheet metal.

20. The lamp according to claim 14, wherein the flexible connecting section is bent through an angle of about 45° or less.

21. The lamp according to claim 14, wherein the first and second filament sections are not co-planar.

22. The lamp according to claim 14, wherein the first and second filament sections are physically connected to one another only by the flexible connecting section.

23. The lamp according to claim 14, wherein at least one of:

the first side on which the first plurality of LEDs is mounted is a surface of the first substrate; and the second side on which the second plurality of LEDs is mounted is a surface of the second substrate.

24. The lamp according to claim 14, wherein the first longitudinal filament section and the second longitudinal filament section are situated immediately adjacent one another such that, in an unbent state of the flexible connecting section, there is no appreciable gap between the first substrate and the second substrate.

25. The lamp according to claim 14, wherein the first substrate and the second substrate physically contact one another at the ends where the flexible connecting section is disposed.

26. The lamp according to claim 14, wherein the lamp further comprises a socket mounted to the lamp base, wherein the holding structure is mounted to the socket.

* * * * *